US008555792B2

(12) United States Patent
Berendes

(10) Patent No.: US 8,555,792 B2
(45) Date of Patent: Oct. 15, 2013

(54) DEVICE FOR INVALIDATING VALUE NOTES

(75) Inventor: Elmar Berendes, Warburg-Noerde (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 13/698,212

(22) PCT Filed: May 17, 2011

(86) PCT No.: PCT/EP2011/057966
§ 371 (c)(1),
(2), (4) Date: Nov. 15, 2012

(87) PCT Pub. No.: WO2011/144611
PCT Pub. Date: Nov. 24, 2011

(65) Prior Publication Data

US 2013/0055932 A1 Mar. 7, 2013

(30) Foreign Application Priority Data

May 17, 2010 (DE) ..... 10 2010 016 970

(51) Int. Cl.
*E05G 1/00* (2006.01)

(52) U.S. Cl.
USPC ..... 109/25; 109/29; 109/33; 109/36

(58) Field of Classification Search
USPC ..... 109/20, 25, 29–36
See application file for complete search history.

(56) References Cited

U.S. PATENT DOCUMENTS

| | | | | | |
|---|---|---|---|---|---|
| 1,606,258 | A | * | 11/1926 | Morssen | 109/25 |
| 1,606,516 | A | * | 11/1926 | Morssen | 109/25 |
| 2,073,820 | A | * | 3/1937 | Von Berg | 219/260 |
| 2,384,826 | A | * | 9/1945 | Ferguson | 109/25 |
| 3,344,757 | A | * | 10/1967 | Touyet | 109/25 |
| 3,349,729 | A | * | 10/1967 | Olivier | 109/25 |
| 4,273,478 | A | * | 6/1981 | Cedergren | 406/189 |
| 4,391,203 | A | * | 7/1983 | Millar | 109/25 |
| 4,722,435 | A | * | 2/1988 | Mareels et al. | 206/1.5 |
| 4,799,435 | A | | 1/1989 | Boutroy | |
| 4,852,502 | A | * | 8/1989 | Klingberg et al. | 109/25 |

(Continued)

FOREIGN PATENT DOCUMENTS

| | | | |
|---|---|---|---|
| DE | 69702259 | T2 | 10/2000 |
| DE | 102004007581 | B4 | 8/2006 |

(Continued)

OTHER PUBLICATIONS

International Search Report (in German and English) and Written Opinion (in German) for PCT/EP2011/057966, mailed Sep. 15, 2011; ISA/EP.

(Continued)

*Primary Examiner* — Suzanne Barrett
(74) *Attorney, Agent, or Firm* — Harness, Dickey & Pierce, P.L.C.

(57) ABSTRACT

The invention relates to a device (10) for invalidating notes of value, comprising a dye stuff container (12, 50), wherein a dye stuff is received for irreversibly dyeing the notes of value. The device (10) further comprises a trigger unit (14, 52) which brings the dye stuff into contact with the notes of value. The trigger unit (14, 52) is arranged inside the dye stuff container (12, 50).

9 Claims, 5 Drawing Sheets

(56) References Cited

U.S. PATENT DOCUMENTS

| | | | | |
|---|---|---|---|---|
| 5,598,793 | A * | 2/1997 | Lopez, Jr. | 109/25 |
| 5,655,461 | A * | 8/1997 | Gilbert | 109/20 |
| 5,787,819 | A * | 8/1998 | Fumanelli | 109/38 |
| 6,453,828 | B1 * | 9/2002 | Fumanelli | 109/25 |
| 6,536,348 | B1 * | 3/2003 | Gral | 102/293 |
| 6,564,726 | B1 * | 5/2003 | Lindskog | 109/25 |
| 6,568,336 | B2 | 5/2003 | Van Lint | |
| 6,701,854 | B1 * | 3/2004 | Gral | 109/25 |
| 6,712,011 | B2 * | 3/2004 | Fumanelli | 109/20 |
| 6,895,873 | B1 * | 5/2005 | Searle | 109/25 |
| 7,121,215 | B2 * | 10/2006 | Besnard | 109/25 |
| 7,395,766 | B2 | 7/2008 | Landwehr et al. | |
| 7,533,801 | B2 * | 5/2009 | Besnard | 235/379 |
| 8,047,142 | B2 * | 11/2011 | Villiger | 109/25 |
| 2003/0033965 | A1 | 2/2003 | Van Lint | |
| 2004/0154500 | A1 * | 8/2004 | Richard et al. | 109/25 |
| 2007/0163987 | A1 | 7/2007 | Landwehr et al. | |
| 2009/0235847 | A1 | 9/2009 | Villiger | |
| 2012/0261876 | A1 | 10/2012 | Berendes | |

FOREIGN PATENT DOCUMENTS

| | | | |
|---|---|---|---|
| FR | 2595491 | A1 | 9/1987 |
| GB | 2430469 | A | 3/2007 |
| WO | WO2006084853 | A1 | 8/2006 |

OTHER PUBLICATIONS

International Preliminary Report on Patentability (Chapter I of the Patent Cooperation Treaty) for PCT/EP2011/057966, (in English), issued Nov. 20, 2012.

* cited by examiner

DEVICE FOR INVALIDATING VALUE NOTES

CROSS-REFERENCE TO RELATED APPLICATIONS

This application is a National Stage of International Application No. PCT/EP2011/057966, filed May 17, 2011, and published in German as WO 2011/144611 A1 on Nov. 24, 2011. This application claims the benefit and priority of German Application No. 10 2010 016 970.6, filed May 17, 2010. The entire disclosures of the above applications are incorporated herein by reference.

BACKGROUND

This section provides background information related to the present disclosure which is not necessarily prior art.

1. Technical Field

The invention relates to a device for invalidating notes of value, comprising a dye stuff container in which the dye stuff for irreversibly dyeing the notes of value is received, and a trigger unit which brings the dye stuff into contact with the notes of value.

2. Discussion

In order to prevent cash boxes from being manipulated such cash boxes are provided with so-called ink kits. When a manipulation attempt is detected by means of a corresponding sensor the ink kit is triggered, and the notes of value stored in the cash box are irreversibly dyed by means of a dye stuff. The notes of value dyed this way cannot be circulated by a potential thief and are thus unusable for him/her.

When the ink kit is triggered carbon dioxide is conveyed from a gas cartridge into the dye stuff container so that an internal pressure is built up in the dye stuff container that exceeds the pressure surrounding the dye stuff container so that due to the pressure difference the dye stuff is expelled from the dye stuff container, and is sprayed on the notes of value, thus dyeing the same.

In known ink kits the gas cartridge is located outside the dye stuff container and is connected with the dye stuff container via corresponding connecting elements such that the gas cartridge's gas is conveyed to the dye stuff container when the ink kit has been triggered. This structure bears the problem that a relatively large space is required, and that the connecting elements between the gas cartridge and the dye stuff container increase the error-proneness which leads to a higher failure probability. An ink kit is, for example, known from document WO 2006/084853 A1.

SUMMARY OF THE INVENTION

It is an object of the invention to specify a device for invalidating notes of value having a simple and compact structured.

Via arranging the trigger unit inside the dye stuff container a compact, space-saving structure of the device is achieved, so that less space is required when the device is employed, for example, in cash boxes, and the space is available for other purposes. Via arranging the trigger unit inside the dye stuff container it is further achieved that the trigger unit is protected by the dye stuff container. In order to prevent manipulation attempts the dye stuff container can in particular comprise a mechanical and/or electrical protection against drilling by means of which drilling of the dye stuff container is prevented and/or the ink kit is triggered in case drilling is attempted. Via arranging the trigger unit inside the dye stuff container, this unit, too, is protected by means of the protection against drilling. The mechanical protection against drilling is in particular formed by using a drill resistant material for the dye stuff container. An electrical protection against drilling can, for example, consist of sensors which detect drilling of the dye stuff container and in that case trigger the device.

Further, by arranging the trigger unit inside the ink container it is achieved that it is not necessary to use further components or few components, respectively, connecting the trigger unit with the dye stuff container so that the number of components required is reduced, thereby reducing effort, error-proneness and costs.

The trigger unit is in particular at least partially surrounded by the dye stuff. Thereby it is achieved that no further components are required which separate the trigger unit from the dye stuff located inside the dye stuff container, whereby a simple structure is achieved.

The trigger unit preferably comprises a gas cartridge filled with gas or a gas liquefied to a liquid, wherein when the device is triggered the dye stuff is conveyed by means of the gas of the gas cartridge through at least one opening of the dye stuff container and is brought into contact with the notes of value. In particular, an internal pressure exceeding the ambient pressure is built up in the dye stuff container by means of the gas cartridge so that due to the pressure difference the dye stuff is conveyed from the dye stuff container at high speed. The gas or the liquid, respectively, received in the gas cartridge in particular comprises carbon dioxide. Such carbon dioxide gas pressure cartridges can be provided easily and inexpensively, and allow for simple handling.

Via arranging the trigger unit, and thus the gas cartridge inside the dye stuff container it is achieved that upon triggering the high internal pressure is generated directly inside the dye stuff container. In contrast to structures wherein the gas cartridge is arranged outside the dye stuff container, it is possible to omit corresponding connecting elements through which the gas is supplied into the dye stuff container from the gas cartridge arranged externally, so that a simple and failure unsusceptible structure is achieved.

Further, it is advantageous if a control unit is provided which controls the trigger unit to trigger the device such that at least one gas outlet of the cartridge is opened so that the gas escapes from the gas cartridge into the dye stuff container and the dye stuff is conveyed through the opening of the dye stuff container. For this purpose, the trigger unit comprises in particular an initiator by means of which the gas outlet of the gas cartridge is opened upon triggering. This initiator can be formed as an electric initiator and/or as a pyrotechnic initiator. As an alternative, a valve can be provided. In a preferred embodiment of the invention, the initiator comprises a blasting cap which is initiated for triggering the device, whereby the gas outlet is burst open and the highly pressurized gas of the gas cartridge can escape immediately so that the dye stuff is promptly conveyed from the dye stuff container at high speed, and the notes of value are dyed faster than a potential thief is capable of removing them.

The gas or the liquid, respectively, in the gas cartridge in particular has a pressure exceeding the ambient pressure so that after opening the gas outlet of the gas cartridge the gas increases the internal pressure of the dye stuff container. Thereby quick and immediate spraying of the dye stuff onto the notes of value is achieved.

The dye stuff conveyed through the opening of the dye stuff container is sprayed onto the notes of value in particular by means of a distribution unit. The distribution unit preferably comprises at least one distribution plate having one opening or a plurality of openings for spraying the dye stuff, a conduct arrangement for spraying the dye stuff and/or at least one nozzle for spraying the dye stuff. Thereby good distribution of the dye stuff is achieved so that all notes of value are contacted by the dye stuff and are thus invalidated.

A further aspect of the invention relates to a cash box having a receiving compartment and/or a roller storage for receiving notes of value, and at least a device for invalidating the notes of value received in the receiving compartment or the roller storage, respectively. The device for invalidating the notes of value received is formed as described above. Via arranging the trigger unit inside the dye stuff container a space-saving structure of the device for invalidating notes of value is achieved, so that small space is required inside the cash box for accommodating the device, the space being available for other components, in particular for a receiving compartment as large as possible or a roller storage as large as possible for receiving a great number of notes of value.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention result from the following description which in connection with the enclosed Figures explains the invention in more detail with reference to embodiments.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
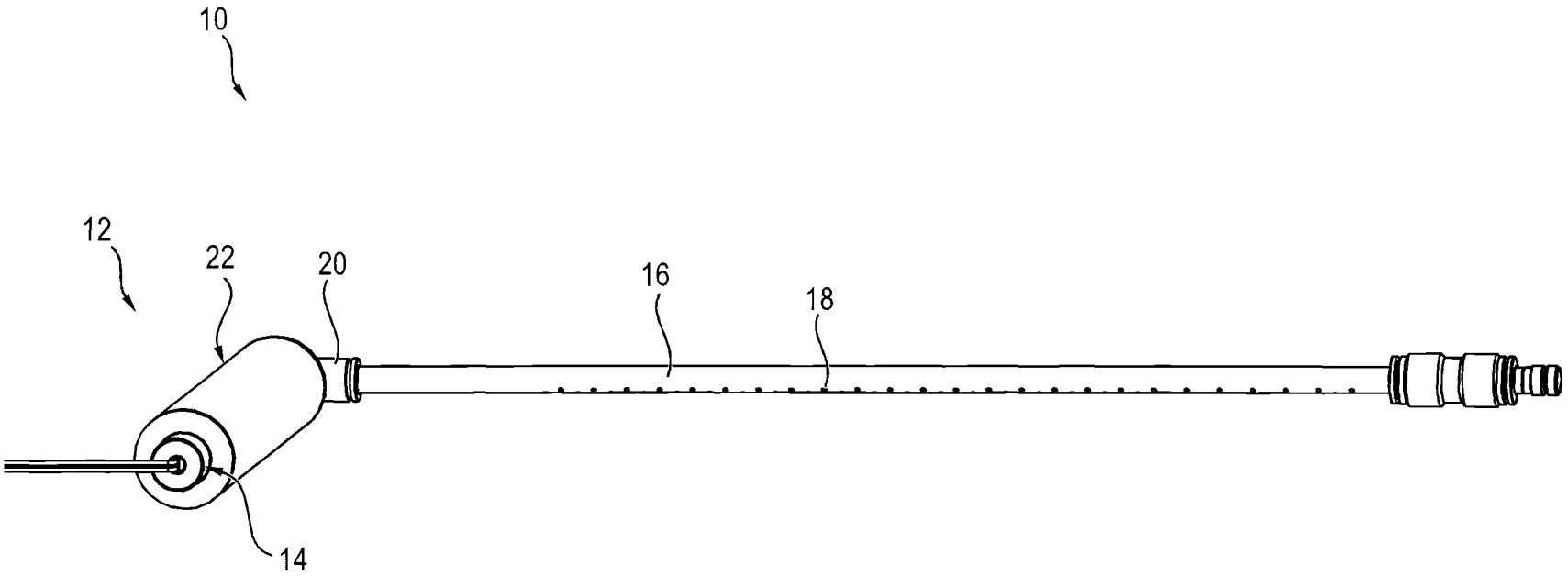
FIG. 1 is a schematic perspective illustration of a device for invalidating notes of value according to a first embodiment of the invention.

In FIG. 1, a schematic perspective illustration of a device for invalidating notes of value is shown which is formed as an ink kit 10. The ink kit 10 is in particular employed in cash boxes in order to irreversibly dye the notes of value received in the cash box if a manipulation attempt has been detected, so that a potential thief cannot circulate these notes of value which are consequently of no use for the thief. Alternatively, the ink kit 10 can be likewise employed in other containers, as for example in a transport case.

The ink kit 10 comprises a dye stuff container 12 in which the dye stuff for dyeing the notes of value is received. If a manipulation attempt is detected, a trigger unit 14 conveys the dye stuff from the dye stuff container 12 to a spray pipe 16 having a plurality of openings through which the dye stuff is sprayed onto the notes of value (not shown) so that the notes of value are irreversibly dyed. One of the openings of the spray pipe 16 is exemplarily designated by reference sign 18. In an alternative embodiment of the invention a plurality of spray pipes 16, in particular two spray pipes 16 can be used. Further, one distribution plate or a plurality of distribution plates having a plurality of openings and/or one nozzle or a plurality of nozzles for spraying the dye stuff onto the notes of value can be employed in addition to or alternatively to the spray pipe 16.

Figure 2:
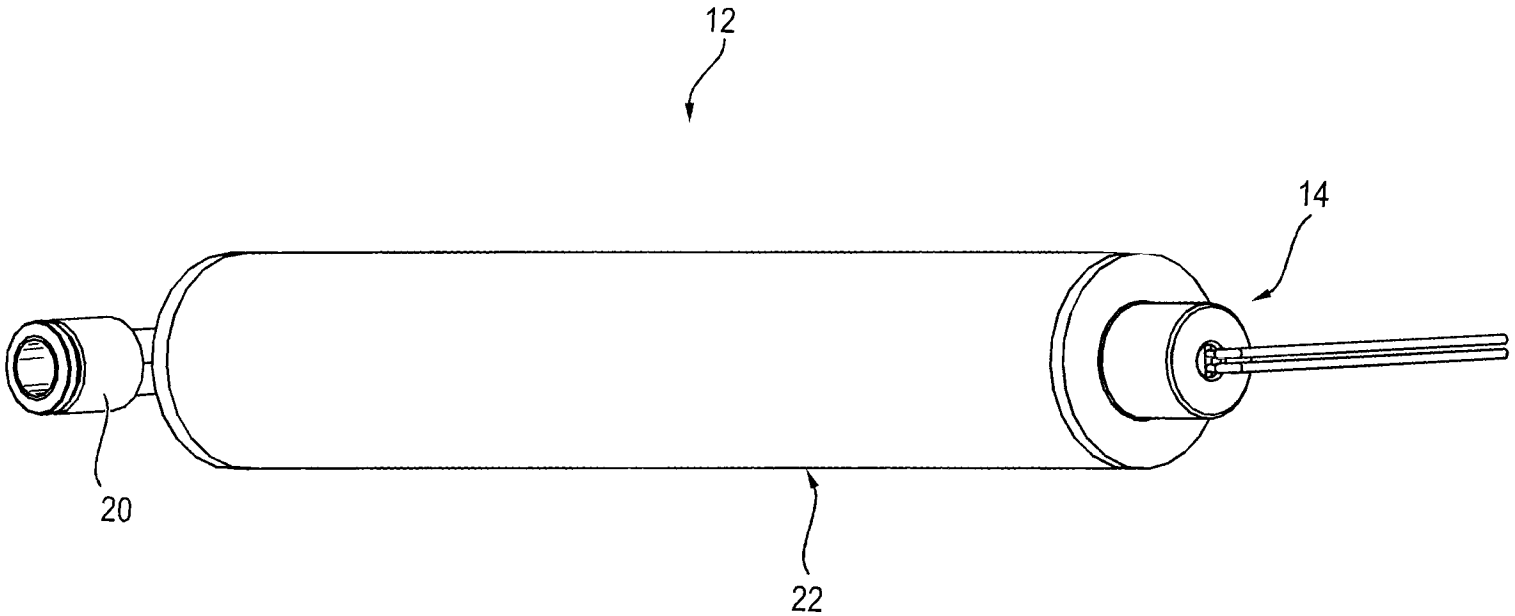
FIG. 2 is a schematic perspective illustration of a dye stuff container of the device according to FIG. 1.

FIG. 2 shows a schematic perspective illustration of the dye stuff container 12, the trigger unit 14 and a connecting element 20 for connecting the dye stuff container 12 with the spray pipe 16 (not shown). Components having the same structure or same function are designated by the same reference signs.

Figure 3:
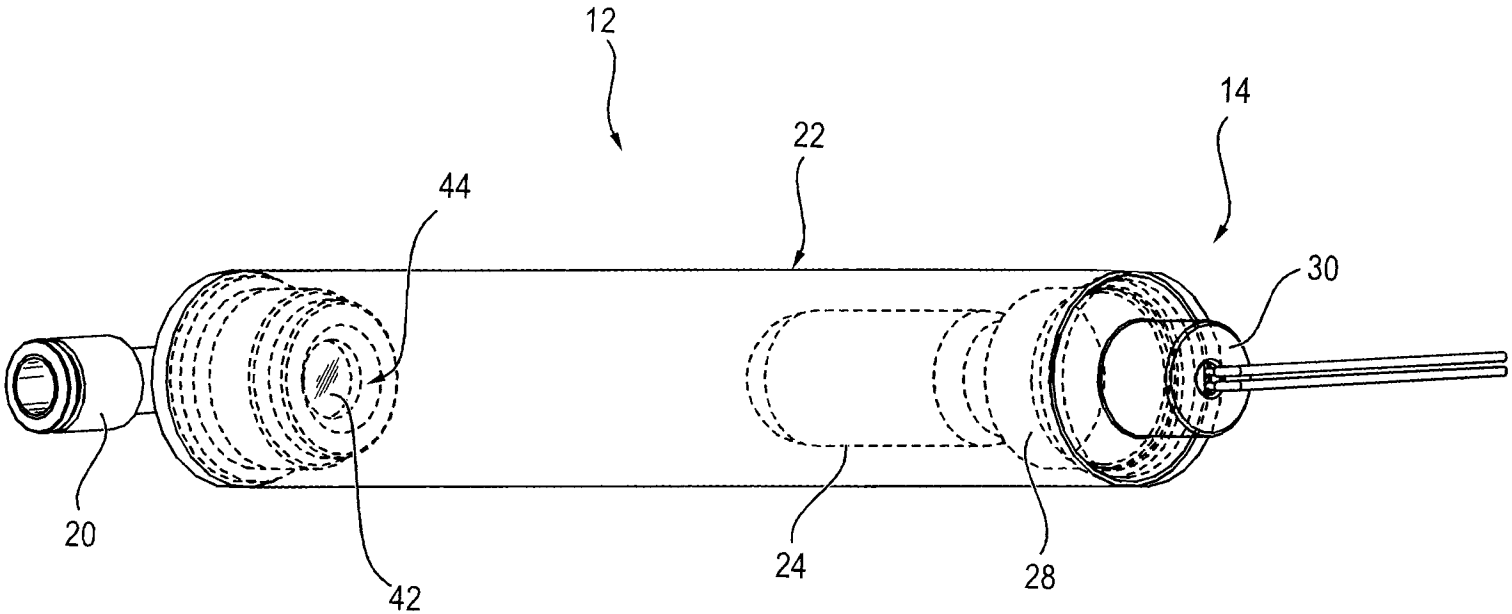
FIG. 3 is a further schematic perspective illustration of the dye stuff container according to FIG. 2.
Figure 4:
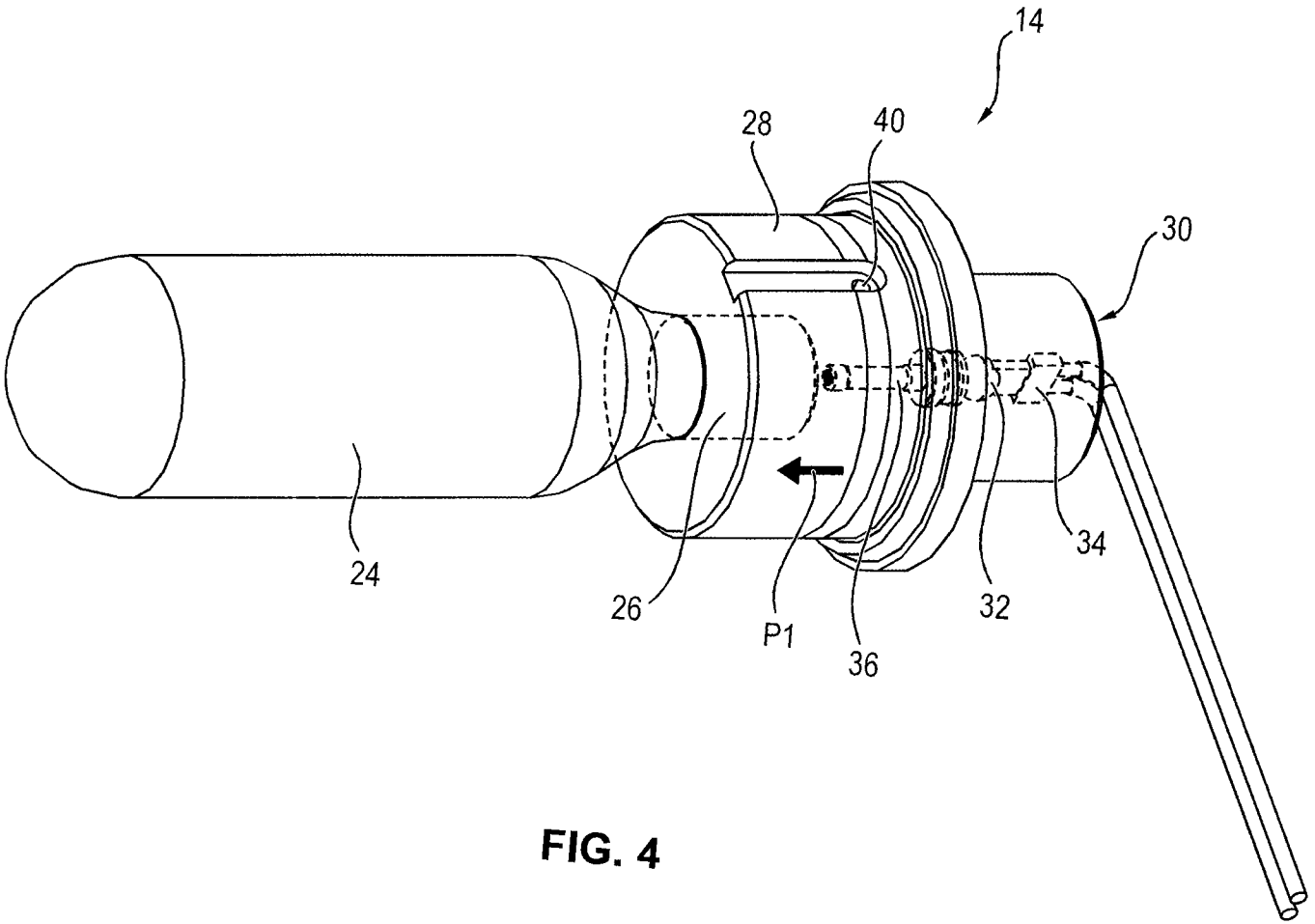
FIG. 4 is a schematic perspective illustration of a trigger unit of the device according to FIG. 1 through 3.

FIG. 3 shows a further schematic perspective illustration of the dye stuff container 12, the trigger unit 14 and the connecting element 20, wherein those components of the trigger unit 14 and the connecting element 20 that are hidden by the outer wall 22 of the dye stuff container 12 are indicated by dashed lines. FIG. 4 shows an enlarged view of the trigger unit 14.

The trigger unit 14 comprises a gas cartridge 24, in which a gas, in particular carbon dioxide, or a gas liquefied to a liquid is received, the internal pressure of the gas cartridge 24 significantly exceeding the ambient pressure. The neck 26 of the gas cartridge 24 is received in a receiving element 28 so that the gas cartridge is held stationary even when the ink kit is triggered due to opening of a gas outlet of the gas cartridge 24. Movement of the gas cartridge 24 inside the dye stuff container 12 is thereby prevented so that damages to other components are avoided.

The trigger unit 14 further comprises an initiating element 30 having a blasting cap 32 which can be initiated via an electric initiator 34. When the blasting cap 32 is initiated a firing pin 36 is shot in direction of the arrow P1 toward the front face of the neck 26 of the gas cartridge 24 so that the front face is penetrated by the firing pin 36 and an outlet of the gas cartridge 24 is opened. Due to the internal pressure of the gas cartridge 24 a major part of the gas immediately escapes from the gas cartridge 24 and gets, through a channel 40, from the receiving element 28 into that space of the dye stuff container 12 where also the dye stuff in received.

The gas escaping from the gas cartridge 24 increases the internal pressure of the dye stuff container 12 until a burst disk 42 of the connecting element 20 bursts and the dye stuff is conveyed through the opening 44 thus generated via the connecting element 20 into the spray pipe 16 so that it is sprayed through the openings 18 of the spray pipe 16 onto the notes of value to be invalidated. In an alternative embodiment of the invention the opening 44 of the connecting element 20 can be closed by a diaphragm instead of a burst disk 42.

Through integrating the trigger unit 14, in particular the gas cartridge 24 into the dye stuff container 12 a compact structure of the ink kit 10 is achieved. Further it is achieved that the gas reaches the dye stuff container 12 immediately for pressurization so that the dye stuff received in the dye stuff container 12 is sprayed via the spray pipe 16 quickly and reliably.

In a preferred embodiment of the invention the wall of the dye stuff container 12 has a protection against drilling by means of which drilling of the wall, and thus discharging of the dye stuff is prevented. This protection against drilling can be formed mechanically as well as electrically. Through arranging the trigger unit 14 inside the dye stuff container 12 it is achieved that the trigger unit 14, too, is protected against manipulations by means of this protection against drilling.

Figure 5:
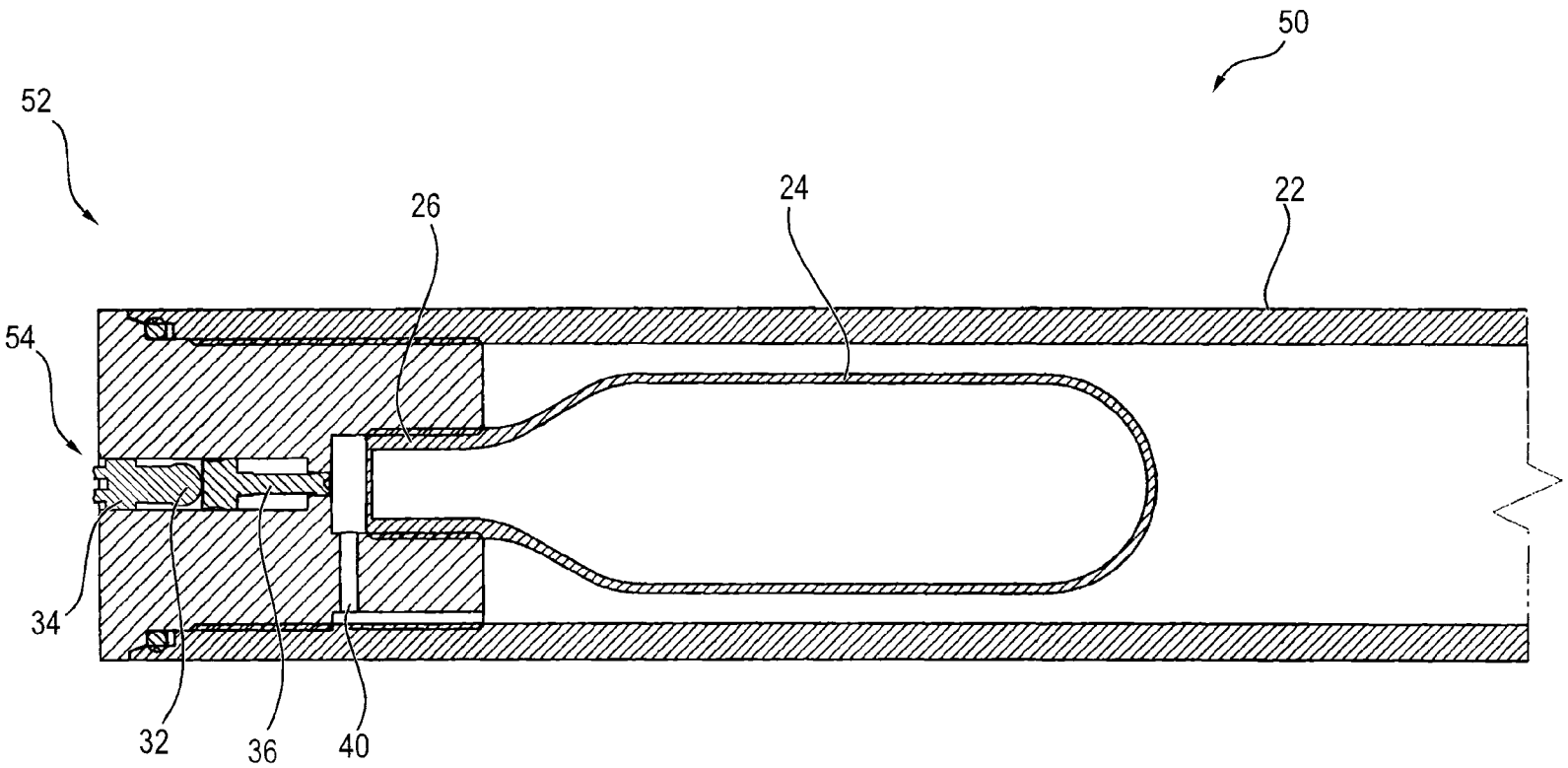
FIG. 5 is a schematic sectional illustration of a dye stuff container according to a second embodiment of the invention.

FIG. 5 shows a schematic perspective illustration of a dye stuff container 50 and a trigger unit 52 according to a further embodiment of the invention, wherein in this embodiment the initiating element 54 of the trigger unit 52 is arranged inside the dye stuff container 50 so that a structure is achieved which is even more compact in comparison with the embodiment shown in FIG. 1 through 4.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A device for invalidating notes of value, comprising:

a dye stuff container having an interior compartment;

dye stuff in the interior compartment of the container;

a trigger unit including a gas cartridge in direct contact with the dye stuff in the interior compartment of the container; and the trigger unit further including a device for causing gas in the gas cartridge to escape directly from the gas cartridge into the interior compartment containing the dye stuff; wherein the dye stuff is forced from the container to contact notes of value.

2. The device according to claim 1, wherein the trigger unit comprises a gas cartridge filled with a gas or a gas liquefied to a liquid, and that upon triggering of the device the dye stuff is conveyed through at least one opening of the dye stuff container by means of the gas.

3. The device according to claim 2, wherein the gas or the liquid, respectively, comprises carbon dioxide (CO2).

4. The device according to claim 2, wherein a control unit is provided which controls the trigger unit for triggering the device in a way that the trigger unit opens at least one gas outlet of the gas cartridge so that the gas escapes from the gas cartridge into the dye stuff container and conveys the dye stuff through the opening of the dye stuff container.

5. The device according to claim 2, wherein the gas in the gas cartridge has a pressure exceeding the ambient pressure, and that after opening a gas outlet of the gas cartridge the gas increases the internal pressure of the dye stuff container.

6. The device according to claim 2, wherein a distribution unit is provided for spraying the dye stuff conveyed through the opening of the dye stuff container onto the notes of value.

7. The device according to claim 6, wherein the distribution unit comprises at least a distribution plate having a plurality of openings for spraying the dye stuff, a conduct arrangement for spraying the dye stuff and/or at least a nozzle for spraying the dye stuff.

8. A cash box, comprising a receiving compartment for receiving notes of value; and comprising a device for invalidating the notes of value received in the receiving compartment, according to claim 1.

9. A device for invalidating notes of value, comprising:

a dye stuff cylinder having an interior compartment defined by a wall, the wall being configured to resist drilling through the cylinder by an unauthorized user;

dye stuff in the interior compartment of the cylinder;

a trigger unit including a gas cartridge in direct contact with the dye stuff in the interior compartment of the container; and the trigger unit further including an initiator device for causing gas in the gas cartridge to escape directly from the gas cartridge into the interior compartment containing the dye stuff; wherein the dye stuff is forced from the container to contact notes of value; and said gas cartridge and initiator device being completely contained within the walls of the cylinder for additional protection.

* * * * *